United States Patent [19]

Mackie

[11] 4,273,021

[45] Jun. 16, 1981

[54] MUTES FOR WIND INSTRUMENTS

[76] Inventor: Robert D. Mackie, 4 Parkdale Rd., Bakersfield, Nottingham, England

[21] Appl. No.: 92,488

[22] Filed: Nov. 8, 1979

[51] Int. Cl.[3] ..... G10D 9/06

[52] U.S. Cl. ..... 84/400

[58] Field of Search ..... 84/400

[56] References Cited

U.S. PATENT DOCUMENTS

| | | | |
|---|---|---|---|
| 2,318,535 | 5/1943 | Spivak | 84/400 |
| 2,571,809 | 10/1951 | Altosino | 84/400 |

*Primary Examiner*—Lawrence R. Franklin

*Attorney, Agent, or Firm*—Bucknam and Archer

[57] ABSTRACT

A mute for a wind instrument comprising a hollow shell adapted for fitting in the bell of the wind instrument and having an inlet and outlet for air passing through the instrument, the shell having an anechoic chamber located between and communicating with said inlet and outlet, a tube extending towards said inlet and defining an exit passage from the chamber, a baffle arranged within the shell between the chamber and the outlet, so as to permit passage of air only around its periphery, the tube being arranged to direct air exiting from the chamber towards the central region of the baffle and being arranged to function as an anegergic means so as to dampen sound waves travelling from the chamber to the baffle.

6 Claims, 2 Drawing Figures

MUTES FOR WIND INSTRUMENTS

This invention is concerned with providing a mute for a wind instrument, especially for practice purposes.

Bell-mouthed wind instruments tend to be loud and this is especially so for brass instruments such as trumpets, trombones and horns. It is known to provide mutes for such instruments for the purpose of modifying the sound produced, but these mutes also produce an undesirable distortion of the notes being played. It is a general object of the present invention to provide a mute which will produce the desired reduction in volume but will not distort the notes being played.

The present invention provides a mute for a wind instrument comprising a hollow shell adapted for fitting in the bell of the wind instrument and having an inlet and outlet for air passing through the instrument, the shell having an anechoic chamber located between and communicating with said inlet and outlet, a tube extending toward said inlet and defining an exit passage from the chamber, a baffle arranged within the shell between the chamber and the outlet, so as to permit passage of air only around its periphery, the tube being arranged to direct air exiting from the chamber towards the central region of the baffle and being arranged to function as an anenergic means so as to dampen sound waves travelling from the chamber to the baffle.

Figure 2:
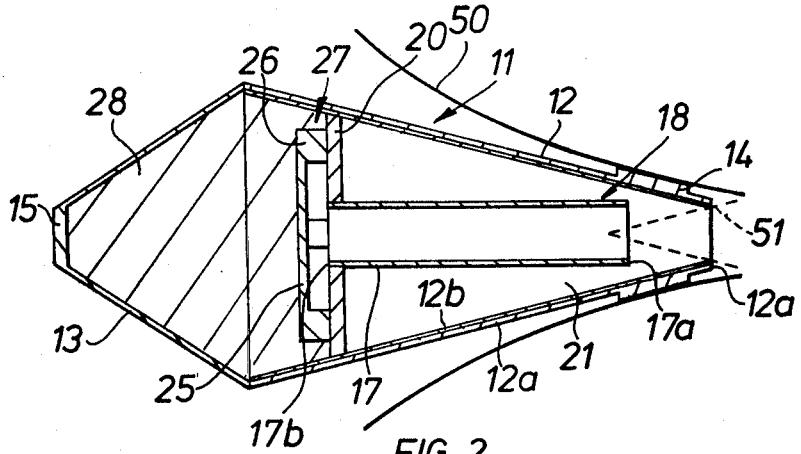
Figure 1:
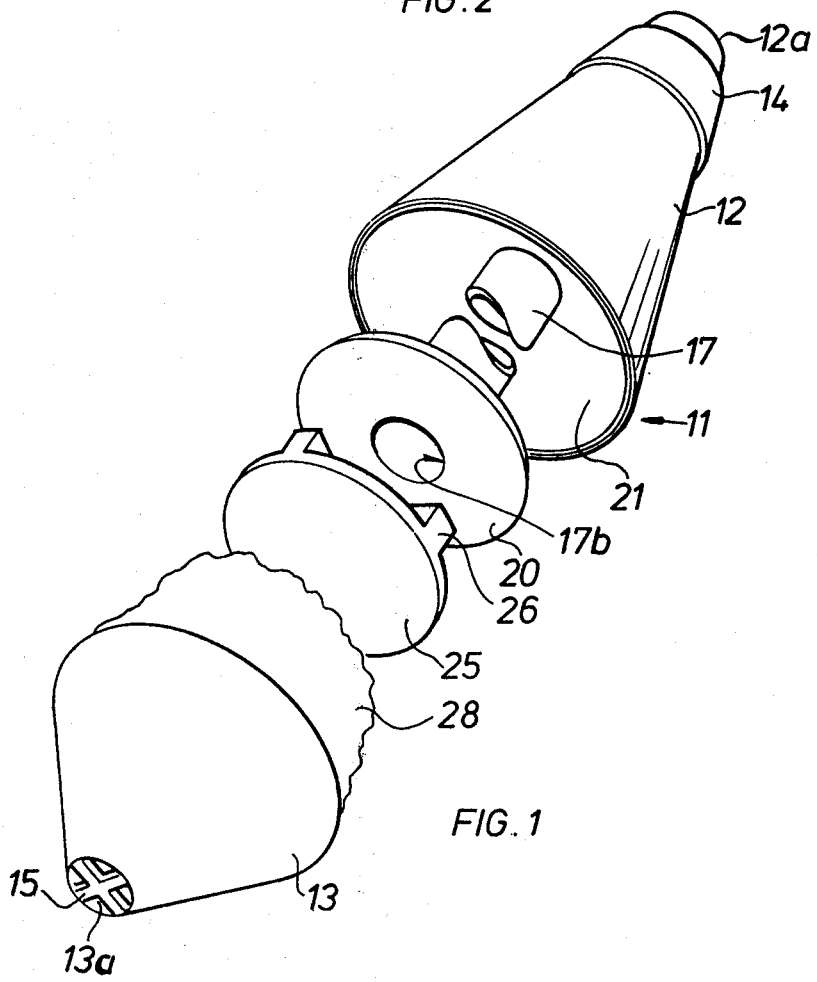

Reference is now made to the accompanying drawings, wherein:

FIG. 1 is a perspective, exploded view of a mute according to the invention; and FIG. 2 is a sectional view of the mute of FIG. 1.

The mute shown comprises a shell 11 including an elongate hollow first cone 12 and a relatively short, hollow second cone 13 of larger cone angle, the two cones having ends, remote from the apices, of the same diameter, these ends being adhered together circumferentially to define the shell. The shell is made of stiff material, the first cone 12 being composed, in one example, of laminated, oiled paper and the second cone being composed of a suitable rigid plastics material. If desired, cones 12 and 13 may be formed from the same material.

The apex 12*a* of the first cone is apertured and, adjacent the apex, the cone is provided with a cork collar 14. In use, the cork collar is push-fitted into the bell of a wind instrument, so that all the air passing out of the instrument enters the shell 11 through the apertured apex 12*a* into an anechoic chamber 21. The apex 13*a* of the second cone is also apertured, the aperture here being partially closed by a latticed member 15, which may be of the type often known as a "spider". The inner wall surface 12*a* is flocked in order to provide an anechoic layer 12*b*.

Before adherance of the two parts 12, 13 of the shell together, other elements are provided within the shell. A rigid tube 17 is co-axially mounted within the first cone 12. One end 17*a* of the tube is located adjacent the collar 14 to leave a small annular gap 18 between the cone and tube. The other end 17*b* of the tube is fixed in a complementary aperture in the centre of a disc 20 and the disc is adhered to the inner surface of the first cone, at a position spaced from the wider end thereof, so as to hold the tube in position. The tube 17, therefore, defines an exit passage for air leaving the anechoic chamber. Additionally, since the tube is free to vibrate it acts as an anenergic means so that as air travels through the tube, sounds are reduced in intensity.

As shown in FIG. 2, the length of the tube is chosen so that in use the node 51 formed in the bell 50 of the instrument is located within the tube.

In one example, the tube is composed of a lightweight metal, such as aluminium alloy and the disc is either faced with sound-absorbent material, for instance, it may be flocked, or it is made of sound-absorbent material, such as wood.

A baffle 25 is provided across the opening in the end 17*b* of the tube and spaced from the opening. The baffle comprises a disc provided on one face with projections 26. The projections are butted against the disc 20 and adhered thereto to locate the baffle, which, in this position extends almost across the entire internal diameter of the first cone, so as to leave a narrow annular gap 27 around the baffle.

Air emerging from the baffle 25 is directed on to the anechoic surface 12*b* and so its sound intensity is again reduced.

Padding 28 fills the space between the walls of the second cone 13 and the baffle. The padding may be packed balls of cotton wool.

In use, the moving air in the wind instrument passes into the anechoic chamber 21 and into the tube 17. It will be appreciated that the anechoic chamber 21 ensures that only those sound waves which are moving directly towards the tube pass along the tube and that no sounds reflected by the walls of the chamber enter the tube. Sounds travelling through the tube 17 are reduced in intensity as stated above. Subsequently, the air hits the baffle 25 and is caused to pass around the baffle and through the constricting gap 27 towards the anechoic surface 12*b*. Thus causing a further reduction in sound intensity. The air then passes through padding 28 to exit at the apex 13*a* of the second cone.

The mute, as described above, gives a faithful reproduction of the sound played on the instrument, but at a very low level, such that it is possible to practice the instrument in a room without undue nuisance to other persons in the room.

I claim:

1. A mute for a wind instrument comprising a hollow shell adapted for fitting in the bell of the wind instrument and having an inlet for collecting the air passing through the instrument and an outlet for directing said air in a direction away from the instrument, the shell being partitioned by a sound absorbent rigid barrier spaced from said inlet to define together with an internal wall surface of the shell a first chamber within the shell, said barrier being spaced from said outlet to define a second chamber within the shell; a baffle mounted on the barrier and having a peripheral portion spaced from the internal wall surface of the shell to define therewith an inlet into said second chamber, the internal wall surface of the shell forming the first chamber being an anechoic surface so that said first chamber defines an anechoic chamber; a tube mounted on the barrier so as to extend towards the inlet of the shell and defining an exit passage from the first chamber through the barrier, the tube directing air exiting from the first chamber towards the central region of the baffle and serving as an anenergic means to dampen sound waves travelling from the first chamber to the baffle, said baffle directing air exiting from the first chamber towards the portion of the internal wall surface of the shell to be deflected thereby through said inlet to the second chamber, said portion of the shell having an anechoic surface, the second chamber containing a sound insulating material through which air travelling from the inlet of the second chamber to the outlet of the shell has to pass.

2. A mute according to claim 1, wherein the anechoic surface of said shell wall is an anechoic layer provided by flocking.

3. A mute according to claim 1, wherein the baffle is provided with projections which space the baffle from the barrier and which are secured to the barrier.

4. A mute according to claim 1, wherein the shell comprises an elongate hollow body of circular cross-section, the body having a first portion which in cross-section progressively increases in diameter from the inlet of the shell toward the outlet of the shell and a second integral portion which in cross-section decreases in diameter in a direction from the inlet to the outlet of the shell.

5. A mute according to claim 1, wherein the tube is spaced from the inlet of the shell so that the sound node produced by the instrument is formed within said tube.

6. A mute according to claim 1, wherein said sound insulating material is a fibrous material.

* * * * *